United States Patent [19]

Whalen

[11] Patent Number: 4,965,703

[45] Date of Patent: Oct. 23, 1990

[54] VIBRATION SUPPRESSING HEADLAMP CLIP

[75] Inventor: Greg R. Whalen, No. Vernon, Ind.

[73] Assignee: GTE Products Corporation, Danvers, Mass.

[21] Appl. No.: 439,131

[22] Filed: Nov. 20, 1989

[51] Int. Cl.[5] ..... F21V 15/04

[52] U.S. Cl. ..... 362/61; 362/369; 362/306; 362/390

[58] Field of Search ..... 362/368, 369, 390, 306, 362/61

[56] References Cited

U.S. PATENT DOCUMENTS

| | | | |
|---|---|---|---|
| 3,225,189 | 12/1965 | Pendell | 362/390 X |
| 3,375,367 | 3/1968 | Woodcock | 362/390 |
| 3,375,368 | 3/1968 | Dorsky | 362/306 |
| 3,467,822 | 9/1969 | Plume | 362/390 X |
| 4,128,865 | 12/1978 | Johnson | 362/306 X |

*Primary Examiner*—Allen M. Ostrager
*Attorney, Agent, or Firm*—William E. Meyer

[57] ABSTRACT

An exterior lamp system for a vehicle having a reflector housing coupled by a vibration damping clip is described. The vibration damping clip may be formed a molded portion of a plastic lamp housing. The clip may take to the form of a reversing curve structure made from a flexible material. One end of the clip is coupled to the lamp housing, while the other end is in contact with the automobile. A damper formed from a vibration damping material, such as foamed plastic, is coupled between the first and second clip ends of the reversing curve to suppress vibration transmitted from the automobile to the lamp.

14 Claims, 2 Drawing Sheets

VIBRATION SUPPRESSING HEADLAMP CLIP

TECHNICAL FIELD

The invention relates to electric lamps and particularly to vehicle tail lamps and headlamps. More particularly the invention is concerned with a coupling mechanism to hold and suppress vibration in vehicle tail lamps and headlamps.

BACKGROUND ART

Currently, most automobile headlamps and tail lamps have filaments that are subject to vibration induced sway that can shorten the filament life. Recent study has shown that arc lamps may also be used as automobile headlamps, but that vibrations applied to the arc discharge can cause the arc to wander, and even attach to the envelope housing, again resulting in a shortened lamp life. There is then a need to help protect filamented and arc discharge light sources of exterior automobile lamps from vibration.

Examples of the prior art are shown in U.S. Pat. Nos. 4,722,032; 4,740,876; 4,742,434; and 4,747,023. U.S. Pat. No. 4,722,032 shows an headlamp with a folded over coupling made from a riveted on spring steel element. U.S. Pat. No. 4,740,876 shows an headlamp bulb mounted on a bracket having reverse curve couplings. U.S. Pat. No. 4,742,434 shows an headlamp with a coupling with one side bolted in place, with the opposite side latched to a reverse curved element. U.S. Pat. No. 4,747,023 Ball shows headlamp with a molded support shoe mated with a spring element to position and hold a headlamp.

DISCLOSURE OF THE INVENTION

A vehicle lamp housing may be formed with a reflector defining a cavity to contain a light source sufficient to provide light for a vehicle, and a retaining clip for the housing coupled to the reflector to assist in positioning and retaining the lamp housing in relation to a vehicle. The preferred retaining clip has a first clip end, a flexible body, and a second clip end such that the first clip end couples to the vehicle and the second clip end couples to the housing. The preferred housing is made as a single body from of a moldable plastic material, and a retaining clip made of a moldable plastic material, having a first clip end, a flexible body, a second clip end including a latch face facing opposite the insertion direction, a second blocking face facing the insertion direction and a vibration damping cross link coupled between the first clip end and the second clip end made of a synthetic foam material wherein the retainer clip latches to substantially position the lamp along the axis of insertion, and the damper is coupled to portions of the retainer clip transverse to the axis of insertion to suppress vibration transverse to the axis of insertion.

BEST MODE FOR CARRYING OUT THE INVENTION

Figure 1:
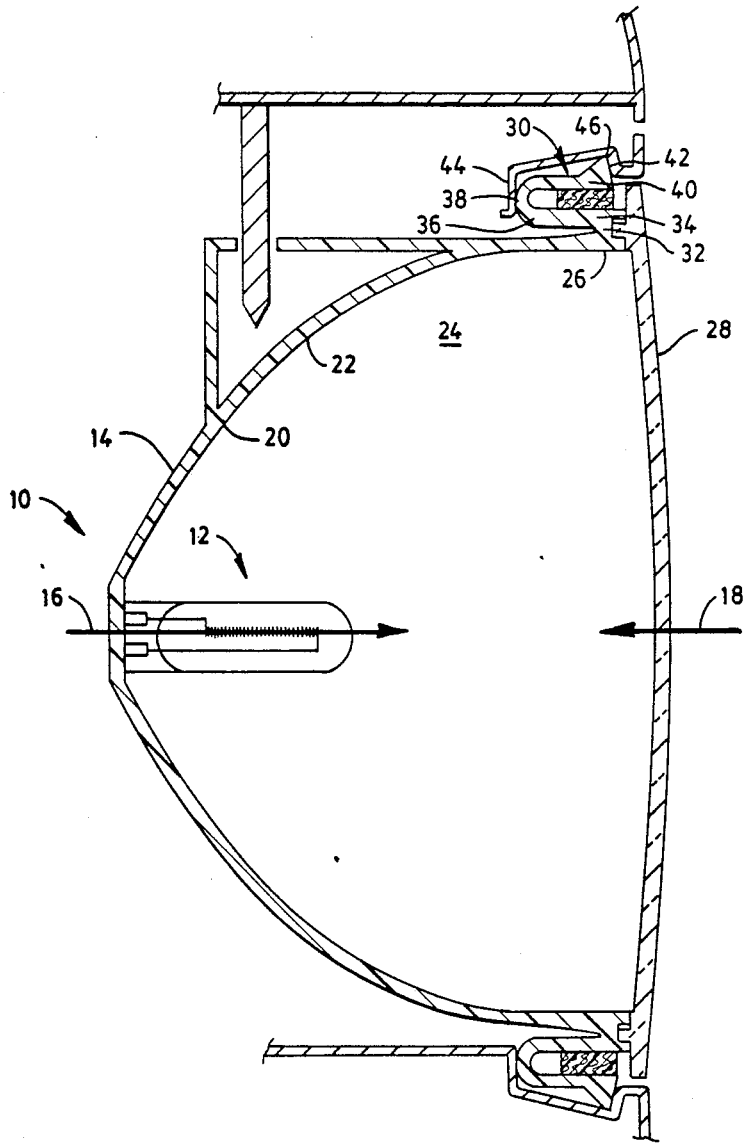
FIG. 1 shows a cross sectional view of a preferred embodiment of a vehicle lamp with a vibration suppressing retaining clip.
Figure 2:
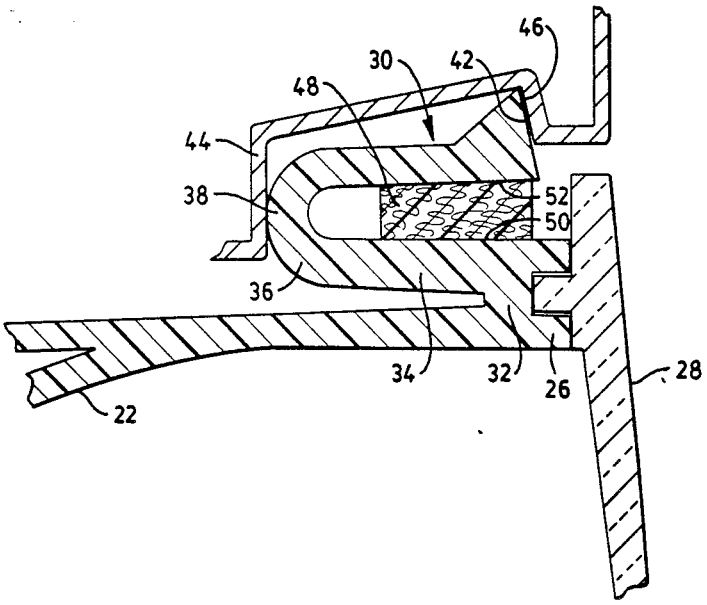
FIG. 2 shows a cross sectional view of a preferred embodiment of a vehicle lamp with a vibration suppressing retaining clip partially broken away.

FIG. 1 shows a cross sectional view of a preferred embodiment of a vehicle lamp 10. The vehicle lamp 10 is assembled from a light source 12, a housing 14, and a retaining clip 30. The light source 12 may be any convenient light source 12 for use in an automobile. Currently, most automobile lamp systems have filaments; however arc discharge and other technologies are being shown in the market place and may become common products. The anticipated first use of the invention is for a tungsten halogen tail lamp, but there is nothing in the present disclosure that limits the disclosure to tail lamps or filamented lamps.

The light source 12 is positioned in the housing 14 to project the generated light forward along an optical axis 16. The optical axis 16 is anticipated to correspond to an insertion direction 18 by which the housing 14 is coupled to a vehicle; however, the two directions need not correspond, and insertion may occur along a direction different from the optical axis. The housing 14 includes a reflector 20 defining by an internal surface 22 a cavity 24 that encloses the light source 12. Along a forward edge of the reflector 20 defining the cavity 24 may be a rim 26. Coupled to the rim 26 may be a lens 28. Mounting and positioning prominences may also be included along the exterior of the housing 14 to position, and couple the housing 14 to an automobile as is generally known in the art of plastic molding and lamp design.

The housing 14 is coupled to the automobile by inserting the housing 14 along the insertion direction 18 into a formed vehicle cavity or recepticle designed to accommodate the housing 14. The housing 14 is then coupled to the vehicle by inserting the rear of the housing 14 and reflector into the vehicle cavity first, leaving the lens 28 facing outwards.

The housing 14 is retained in the vehicle cavity, at least in part, by one or more retaining clips 30. FIG. 1 shows the housing 14 with formed retaining clips 30 positioned near the top, and bottom edges of the housing 14 near the rim 26. By including corresponding clips 30 at opposite sides of the lamp, or otherwise distributed about the circumference, the whole lamp may be inserted, and conveniently positioned in a vehicle as a unit. The opposed clips 30 then allow the reflector to float in a cushioned state on the two, or more clips 30. While only two clips are shown, additional clips may be used to further set the lamp position. It is only important that the additional clips be sufficiently spread along the lamp circumference to adequately support and position the lamp.

The reflector 20 is mechanically coupled to the retaining clip 30 by a coupling 32. The retaining clip 30 has a first clip end 34 that couples to a flexible body 36. The flexible body 36 allows flexion transverse to the insertion direction 18, but is substantially rigid with respect to the insertion direction 18. The flexible body 36 may then be compressed in the direction transverse to the insertion direction 18 during lamp insertion. It may also be useful to form along the length of the flexible body 36 a first latch face 38. The flexible body 36 extends farther to couple with a second clip end 40. By way of example retaining clip 30 is shown in FIG. 1 as a reversing curved element coupled to the housing 14 by a solid, comolded link coupling 32 joining the first clip end 34. The first clip end 34 is coupled by a flexible body 36 to a second clip end 40 through the reversing curve. The reversing curve provides flexibility between the first clip end 34 and second clip end 40.

The second clip end 40 may also conveniently include a second latch face 42. The first latch face 38 may be butted against a first stop face 44. In particular, the first latch face 38 may face in the insertion direction 18, and be aligned to meet the first stop face 44 positioned to face opposite the insertion direction 18. The second latch face 42 may be butted against a second stop face 46. In particular, the second latch face 42 may face opposite the insertion direction 18, and be aligned to meet the second stop face 46 positioned to face the insertion direction 18. The second latch face 42 and the second stop face 46 may be brought into alignment by inserting the lamp 10 and causing the second clip end 40 to be compressed while passing over the end of the second stop face 46 until the first latch face 38 meets the first stop face 44, allowing the second clip end 40 to spring free with the second latch face 42 and second stop face 46 being brought laterally into alignment by the transverse, unspringing motion of the second clip end 40.

Coupled between the first clip end 34 and second clip end 40 may be a vibration damper 48. The first clip end 34 may be coupled to the damper 48 along first damper side 50, while the second clip end 40 may be coupled to a second damper side 52. The first damper side 50 and second damper side 52 are conveniently formed as opposite sides of a block shaped piece. While vibration dampers may have complex mechanical structures, the preferred damper 48 is a simple flexible element, such as a block of rubber or a similar synthetic material. The preferred damper 48 is a foam rubber, such as foamed Neoprene.

While there have been shown and described what are at present considered to be the preferred embodiments of the invention, it will be apparent to those skilled in the art that various changes and modifications can be made herein without departing from the scope of the invention defined by the appended claims. The disclosed operating conditions, dimensions, configurations and embodiments are as examples only, and other suitable configurations and relations may be used to implement the invention.

What is claimed is:

1. A vehicle lamp housing comprising:

(a) a reflector defining a cavity to contain a light source sufficient to provide light for a vehicle, (b) a retaining clip coupled to the reflector to assist in positioning and retaining the lamp housing in relation to a vehicle, the retaining clip having a first clip end, a flexible body, and a second clip end, and (c) a vibration damping cross link coupled between the first clip end coupleable to a vehicle along an insertion direction and the second clip end coupled to the reflector.

2. The apparatus in claim 1, wherein the lamp housing is made of a moldable plastic material.

3. The apparatus in claim 1, wherein the retainer clip is made of a moldable plastic material.

4. The apparatus in claim 1, wherein the lamp housing and the retainer clip are made as a single body from a moldable plastic material.

5. The apparatus in claim 1, wherein the first clip end couples through a reversing flexible bend to the second clip end.

6. The apparatus in claim 1, wherein the retaining clip includes a first latch face facing the insertion direction.

7. The apparatus in claim 1, wherein the second clip end includes a second latch face facing opposite the insertion direction.

8. The apparatus in claim 1, wherein a first latch face is intermediate the length of the clip body between the first clip end and the second clip end.

9. The apparatus in claim 1, wherein the retainer clip latches to substantially position the lead lamp along the insertion direction, and the damper is coupled to portions of the clip retainer transverse to the insertion direction to suppress vibration transverse to the insertion direction.

10. The apparatus in claim 1, wherein the lamp housing is coupled to the first clip end adjacent a first damper end, and the second clip end is coupled to a second damper end adjacent the latch face.

11. The apparatus in claim 1, wherein the damper is made of a springy material.

12. The apparatus in claim 1, wherein the damper is made of a synthetic material.

13. The apparatus in claim 1, wherein the damper is made of a synthetic foam material.

14. A vehicle lamp comprising:

(a) a light source sufficient to provide light for a vehicle (b) a lamp housing, made as a single body from of a moldable plastic material, and (c) a retaining clip made of a moldable plastic material, having (i) a first clip end coupleable to a vehicle along an insertion direction, (ii) a flexible body, (iii) a second clip end coupled to the reflector including a latch face facing opposite the insertion direction (iv) a second blocking face facing the insertion direction and (d) a vibration damping cross link coupled between the first clip end of the retaining clip and the second clip end of the retaining clip made of a synthetic foam material wherein the retainer clip latches to substantially position the lead lamp along the insertion direction, and the damper is coupled to portions of the retainer clip transverse to the insertion direction to suppress vibration transverse to the insertion direction.

* * * * *